US007234334B1

(12) United States Patent
Pfabe

(10) Patent No.: US 7,234,334 B1
(45) Date of Patent: Jun. 26, 2007

(54) SADDLE FOR BACKING ASSEMBLIES IN A ROLLING MILL

(75) Inventor: Dennis P. Pfabe, Canton, OH (US)

(73) Assignee: United Grinding and Machine Company, Canton, OH (US)

( * ) Notice: Subject to any disclaimer, the term of this patent is extended or adjusted under 35 U.S.C. 154(b) by 302 days.

(21) Appl. No.: 10/632,459

(22) Filed: Jul. 31, 2003

Related U.S. Application Data

(60) Provisional application No. 60/400,573, filed on Aug. 2, 2002.

(51) Int. Cl.
*B21B 13/10* (2006.01)
*B21B 29/00* (2006.01)
*B21B 31/32* (2006.01)

(52) U.S. Cl. ..... 72/245; 72/242.4; 72/224; 72/241.4

(58) Field of Classification Search ..... 72/237, 72/238, 239, 240, 241.2, 241.4, 241.6, 241.8, 72/242.2, 242.4, 243.2, 243.4, 243.6, 245, 72/252.5, 224, 246; 492/39; 384/192
See application file for complete search history.

(56) References Cited

U.S. PATENT DOCUMENTS

| | | | | |
|---|---|---|---|---|
| 2,169,711 A | | 8/1939 | Sendzimir | |
| 2,187,250 A | | 1/1940 | Sendzimir | |
| 2,479,974 A | | 8/1949 | Sendzimir et al. | |
| 2,776,586 A | | 1/1957 | Sendzimir | |
| 2,853,245 A | * | 9/1958 | Jacobson | 241/167 |
| 3,815,401 A | | 6/1974 | Sendzimir et al. | |
| 4,289,013 A | | 9/1981 | Hunke | |
| 4,909,641 A | * | 3/1990 | Mc Kenzie | 384/536 |
| 5,265,965 A | * | 11/1993 | Harris et al. | 384/208 |
| 5,421,184 A | * | 6/1995 | Sendzimir et al. | 72/241.4 |
| 5,471,859 A | | 12/1995 | Sendzimir et al. | |
| 5,481,895 A | | 1/1996 | Sendzimir et al. | |
| 5,632,560 A | * | 5/1997 | Dittenhofer | 384/447 |
| 6,616,338 B2 | * | 9/2003 | Tibbits | 384/513 |
| 2003/0021504 A1 | * | 1/2003 | Tibbits | 384/513 |

* cited by examiner

*Primary Examiner*—Dmitry Suhol
(74) *Attorney, Agent, or Firm*—Zollinger & Burleson Ltd

(57) ABSTRACT

A saddle for a backing assembly in a rolling mill has non-cylindrical bearing surfaces that accommodate wear by allowing the saddles to self-align. The non-cylindrical bearing surfaces help prevent the needle bearings from being pinched and driven into the gear rings. The non-cylindrical bearing surfaces are provided in different locations such as intermediate the eccentric and eccentric ring or intermediate the eccentric ring and the saddle ring.

41 Claims, 13 Drawing Sheets

SADDLE FOR BACKING ASSEMBLIES IN A ROLLING MILL

CROSS REFERENCE TO RELATED APPLICATIONS

This application claims priority from U.S. Provisional Patent Application Ser. No. 60/400,573 filed Aug. 2, 2002; the disclosures of which are incorporated herein by reference.

BACKGROUND OF THE INVENTION

1. Technical Field

The present invention generally relates to metal-working rolling mills and, more particularly, to improved saddles that support the backing assemblies that support the second intermediate rolls of the mills. Specifically, the present invention relates to a saddle for a backing assembly in a cluster mill or a Z-mill wherein the saddle includes improved bearing surfaces that accommodate adjustments to reduce wear.

2. Background Information

Rolling mills such as cluster mills, 20-high cluster mills, and Z-high mills are known in the art for cold rolling metal strips. Exemplary mills are disclosed in U.S. Pat. Nos. 2,169,711; 2,187,250; 2,479,974; 2,776,586; 4,289,013; 5,471,859; and 5,481,895. These mills are commonly known as "Sendzimir" mills, "Z" mills or "Sendzimirs."

A prior art cluster mill is depicted in FIGS. 1-5 of the present patent application. FIGS. 1-5 were originally described in U.S. Pat. No. 5,471,859 and substantial portions of this description are repeated herein for the benefit of the reader. A schematic view of a cluster mill 2 is shown in FIG. 5. Cluster mill 2 generally includes a pair of work rolls 12 that are supported by a set of four first intermediate rolls 13 which are in turn supported by a set of six second intermediate rolls including four driven rolls 15 and two non-driven idler rolls 14. A strip of metal 8 passes back and forth between work rolls 12 in order for metal strip 8 to be cold rolled.

The second intermediate rolls 14,15 are supported in turn by eight backing assemblies (identified as A, B, C, D, E, F, G, and H). Each backing assembly includes a plurality of roller bearings 30 mounted upon a shaft 18. Shaft 18 is supported at intervals along its length by saddles 19. Each saddle 19 includes a ring 31 and a shoe 29. Shoes 29 are mounted to a mill housing 10. An example of mill housing 10 may be found in U.S. Pat. No. 3,815,401. Saddles 19 also include eccentrics or eccentric rings 23 that are keyed to shaft 18 with a key 24. Each ring 23 includes a bearing surface at its outside diameter. As described below, the outer bearing surface of each ring 23 either directly engages the inner surface of saddle ring 31 or indirectly engages the inner surface of saddle ring 31. This arrangement provides radial motion of shaft 18 when shaft 18 or ring 23 is rotated.

The art generally labels backing assemblies A-H and the components of backing assemblies A-H as shown in FIG. 5. In FIG. 5 (the operator's side or front of mill 2), the left most upper assembly is labeled "A" and working clockwise around mill 2, the remaining assemblies are labeled "B" through "H." This labeling convention is generally followed in the art and will be followed in this specification such that the labels A-H are applied to backing assemblies and the parts of each backing assembly.

In the case of backing assemblies A, D, E, F, G, and H, saddles 19 are known as "plain saddles" and rings 23 mount directly within saddle rings 31 and slide within rings 31 as shafts 18 are rotated. In these plain saddles, the outer bearing surface of ring 23 directly and frictionally engages the inner bearing surface of saddle ring 31. The direct frictional engagement between ring 23 and saddle ring 31 creates high frictional forces and does not allow shafts 18 to be adjusted under load (during rolling of metal strip 8). Rings 23A, 23D, 23E, and 23H are known as "side eccentrics." Rotation of these side eccentric rings and these side eccentric shafts is used to adjust the radial position of their bearings (30A, 30D, 30E, and 30H) to take up wear on rolls 12-15.

Rings 23F and 23G are known as the "lower screwdown eccentrics." Rotation of shafts 18F and 18G (along with rings 23F and 23G) can be used to take up for roll wear as described above, but is more frequently used to adjust the level of the top surface of lower work roll 12. This is known as "adjusting the pass line height" or "pass line adjustment."

In the case of backing assemblies B and C, saddles 19B and 19C are known as "roller saddles." In small mills that do not have a crown adjustment, the construction of backing assemblies B and C is the same as for the plane saddles, with the exception that a single row of rollers (similar to those shown at 37 in FIG. 3) is interposed between the outside of each ring 23 and the inside of the mating saddle ring 31. The addition of rollers 37 enables the shafts 18B and 18C and rings 23B and 23C to roll within saddle rings 31B and 31C. Rollers 37 reduce the friction sufficiently for adjustment to be made under load. This adjustment is known as the "upper screwdown" or "screwdown" and is used to adjust the roll gap (the gap between work rolls 12) under load. The adjustment is made by using double racks (not shown), one engaging gears 22 on shafts 18B and 18C at the operator's side, and one engaging gears 22 on shafts 18B and 18C at the drive side (see FIG. 4). Each double rack is actuated by a direct acting hydraulic cylinder, and a position servo is used to control the position of the hydraulic pistons, and so control the roll gap.

For larger mills and other newer small mills, provision is made for individual adjustment of the radial position of shaft, bearings, and eccentric rings at each saddle position. This type of adjustment is known in the art as "crown adjustment" and the prior art construction used to achieve "crown adjustment" is generally shown in FIGS. 1-4. On the B and C saddles, saddle rings 31 are provided with a larger diameter bore 32, so that a second set of rollers 33 and a ring 34 (the outside diameter of which is eccentric relative to its inside diameter) can be interposed between saddle ring 31 and rollers 37. Rings 34 are known as "eccentric rings" or "crown adjust rings." A gear ring 38, having gear teeth 40, is mounted on each side of each eccentric ring 34 and rivets 39 are used to retain gear rings 38, eccentric 23, eccentric ring 34, saddle ring 31, and shoe 29, with two sets of rollers 33 and 37, together as one assembly, known as the saddle assembly 19.

As shown in FIGS. 1 and 2, a double rack 41 is used at each saddle location to engage with both sets of gear teeth 40 on each gear ring 38 on both B and C saddle assemblies 19. A hydraulic cylinder, or motor drive jack (not shown), is used at each saddle location in order to translate rack 41. In the example of FIG. 4, seven individual drives are provided with one drive positioned at each saddle location. These drives are known as "crown adjustment" drives. If one drive is operated, its respective double rack 41 moves in a vertical direction, rotating the associated gear rings 38 and eccentric rings 34. This causes radial movement of eccentrics 23 on shafts 18B and 18C at the saddle location on which the eccentric rings 34 rotate, and a corresponding change in the roll gap at that longitudinal location. When this occurs, shafts 18 bend to permit the local adjustment.

Cluster mills of the type described above and depicted in FIGS. 1-5 were designed to slowly shape metal strip 8 by passing strip 8 back and forth between work rolls 12 many times. In today's environment of international price competition, the cluster mills are being pushed beyond their design limits so that the shaping of metal strip 8 may be achieved with fewer passes through work rolls 12. For instance, cluster mill 2 may be designed to adjust the shape of metal strip 8 2% with each pass through work rolls 12. The industry is now running cluster mill 2 to change the shape up to 7% with each pass through work rolls 12. Using cluster mill 2 in this manner increases the wear on the elements of saddles 19 requiring the owners of cluster mills 2 to replace the parts of mill 2 on a frequent maintenance schedule. Specifically, rollers 37 and 33 (also referred to as needle bearings) are pinched by the large adjustments and driven against gear rings 38. When this type of wear occurs, the owner of cluster mill 2 must replace gear rings 38 and grind the appropriate bearing surfaces so that larger needle bearings (rollers 33 and 37) may be retrofit into saddle 19. In addition to worn gear rings and rollers 33 and 37, saddle shoes 29 become warped and must be replaced. This type of undesirable wear is likely to increase as the industry requires faster and faster mill times. The industry will continue to push existing cluster mills to perform shaping operations beyond the original design limitations of the mill creating more and more wear on saddles 19. The art thus desires a saddle configuration that accommodates this type of cluster mill operation in order to reduce wear. Such a saddle configuration must be able to be retrofit into existing cluster mills when the saddles are being repaired.

BRIEF SUMMARY OF THE INVENTION

The invention provides a self-aligning saddle for a backing assembly in a cluster mill having improved bearing surfaces that accommodate wear. In one embodiment, the invention provides non-cylindrical bearing surfaces that prevent point stresses when a crown adjustment is made. The non-cylindrical bearing surfaces help prevent the rollers from being pinched and driven into the gear rings.

The invention provides the improved bearing surface in the plain saddles as well as the roller saddles. In the plain saddle embodiment, the non-cylindrical bearing surfaces are provided directly between the eccentric and the saddle ring. The non-cylindrical bearing surface may be curved concavely or convexly with respect to the eccentric. In the roller saddle embodiment, the non-cylindrical bearing surfaces are provided intermediate the eccentric and eccentric ring or intermediate the eccentric ring and the saddle ring.

In one embodiment, the invention replaces cylindrical roller 33 or 37 with a concave, hour glass-shaped roller that engages complementary convex surfaces formed at the outer surface of the eccentric and the inner surface of the eccentric ring or the outer surface of the eccentric ring and the inner surface of the saddle ring. The invention also provides an embodiment wherein cylindrical roller 33 or 37 of the prior art saddle is replaced with a barrel-shaped bearing having convex outer surfaces that engage a complementary concave surface formed at the outer surface of the eccentric and a curved inner surface formed at the inner surface of eccentric ring or the outer surface of the eccentric ring and the inner surface of the saddle ring.

Another aspect of the invention is the use of gear rings having raceways that receive cylindrical portions of the rollers. A further aspect of the invention is the use of abutment walls to retain position of the rollers.

The invention also provides a cluster mill that incorporates the saddles having the non-cylindrical bearing surfaces. One embodiment provides an embodiment wherein the non-cylindrical bearing surfaces are spherical bearing surfaces.

BRIEF DESCRIPTION OF THE SEVERAL VIEWS OF THE DRAWINGS

Similar numbers refer to similar parts throughout the specification.

DETAILED DESCRIPTION OF THE INVENTION

Figure 1:
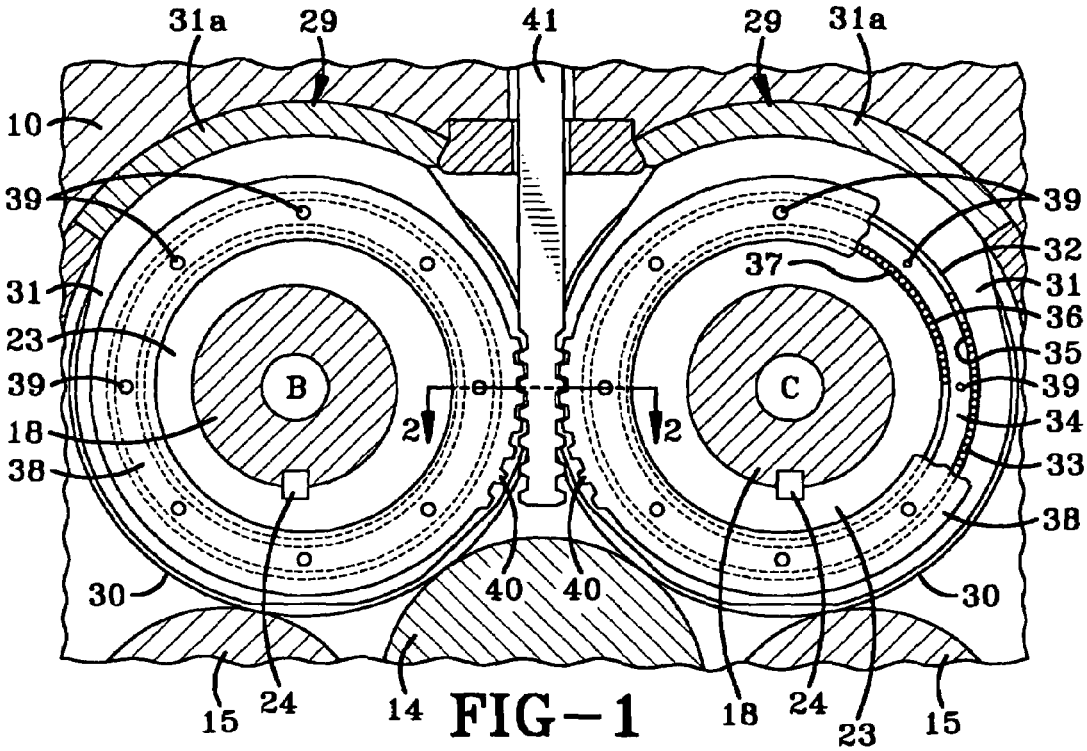
FIG-1 PRIOR ART
FIG. 1 is a fragmentary elevation view, partially in cross-section, of prior art backing assemblies B and C of a prior art cluster mill.
Figure 2:
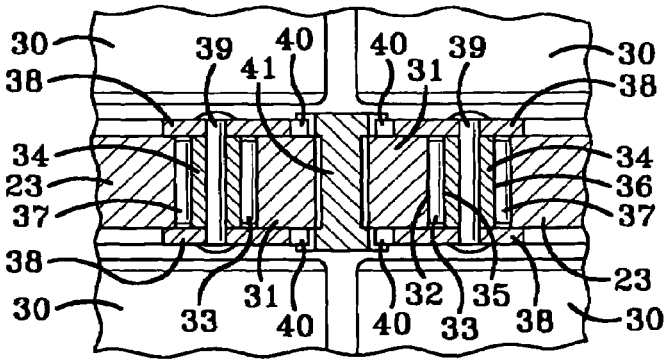
FIG-2 PRIOR ART
FIG. 2 is a fragmentary cross-sectional view taken along section line 2-2 of FIG. 1 showing engagement of one crown adjusting rack and its respective gears.
Figure 3:
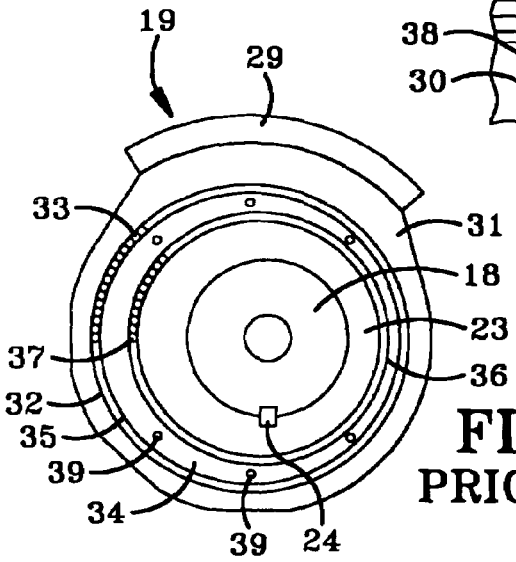
FIG-3 PRIOR ART
FIG. 3 is a cross-sectional view of a typical B and C saddle assembly according to the prior art.
Figure 4:
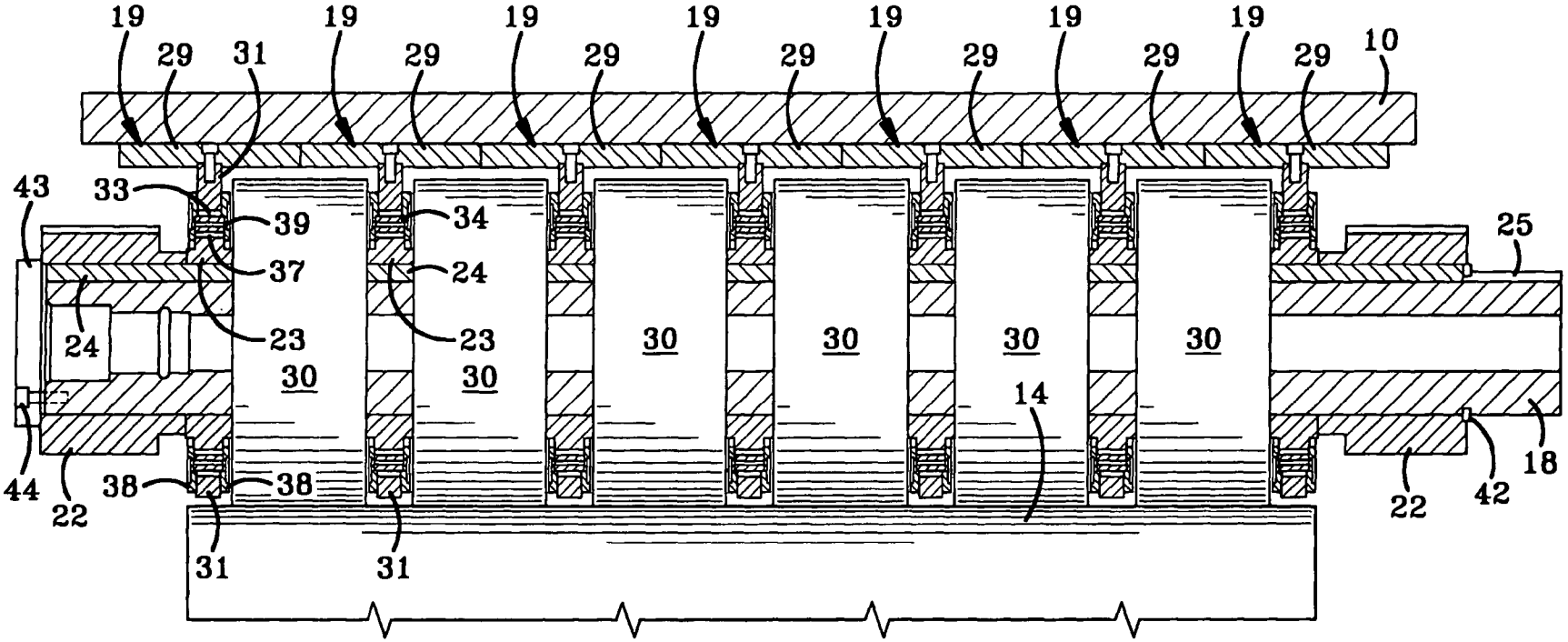
FIG-4 PRIOR ART
FIG. 4 is a longitudinal cross-sectional view of a typical prior art B or C backing assembly having six bearings and seven saddles.
Figure 5:
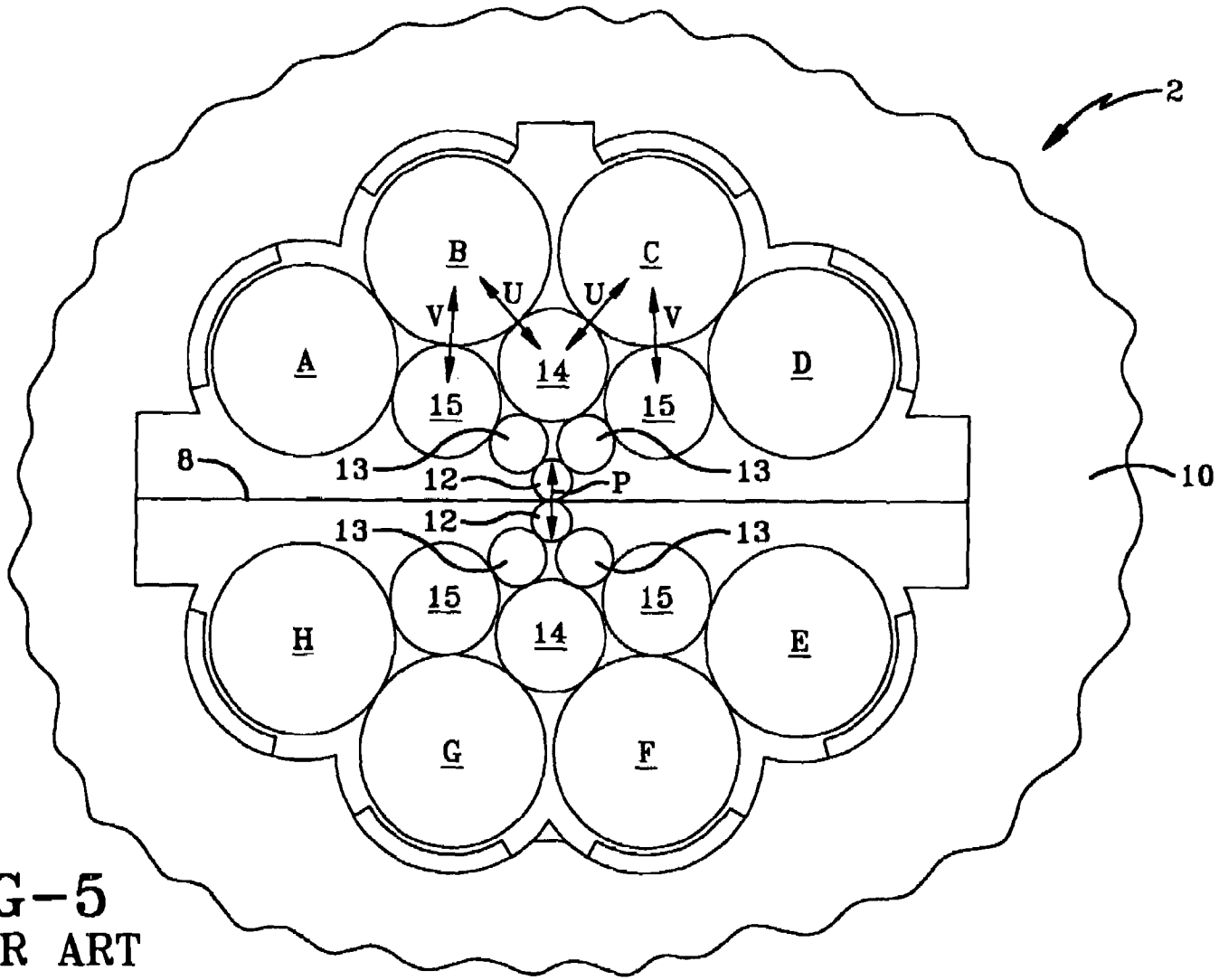
FIG-5 PRIOR ART
FIG. 5 is a fragmentary, schematic, elevational view showing a typical prior art cluster mill, viewed from the operator's side, and showing naming terminology for the backing assemblies.
Figure 6:
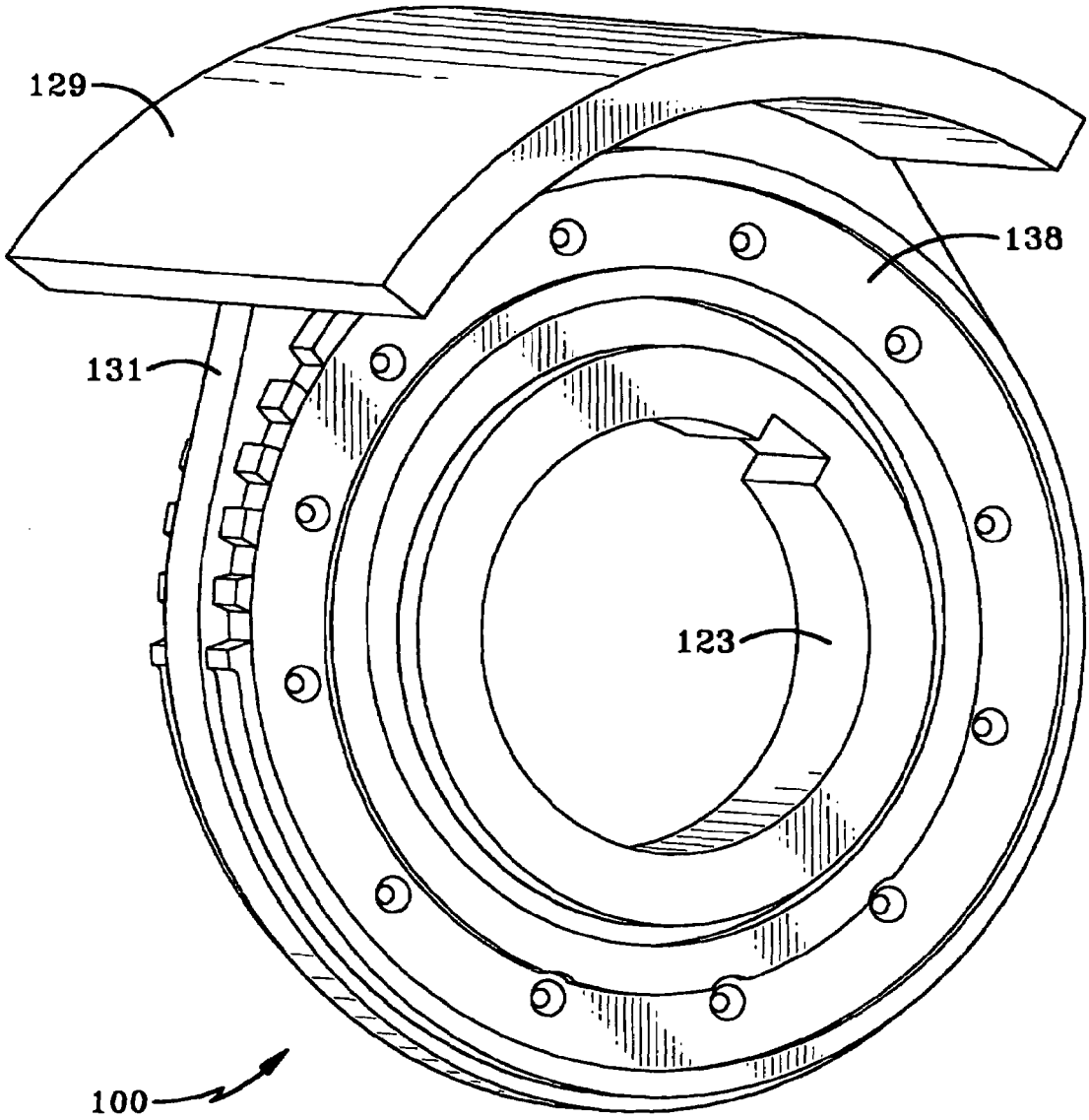
FIG. 6 is a perspective view of a saddle made in accordance with the concepts of the present invention.
Figure 7:
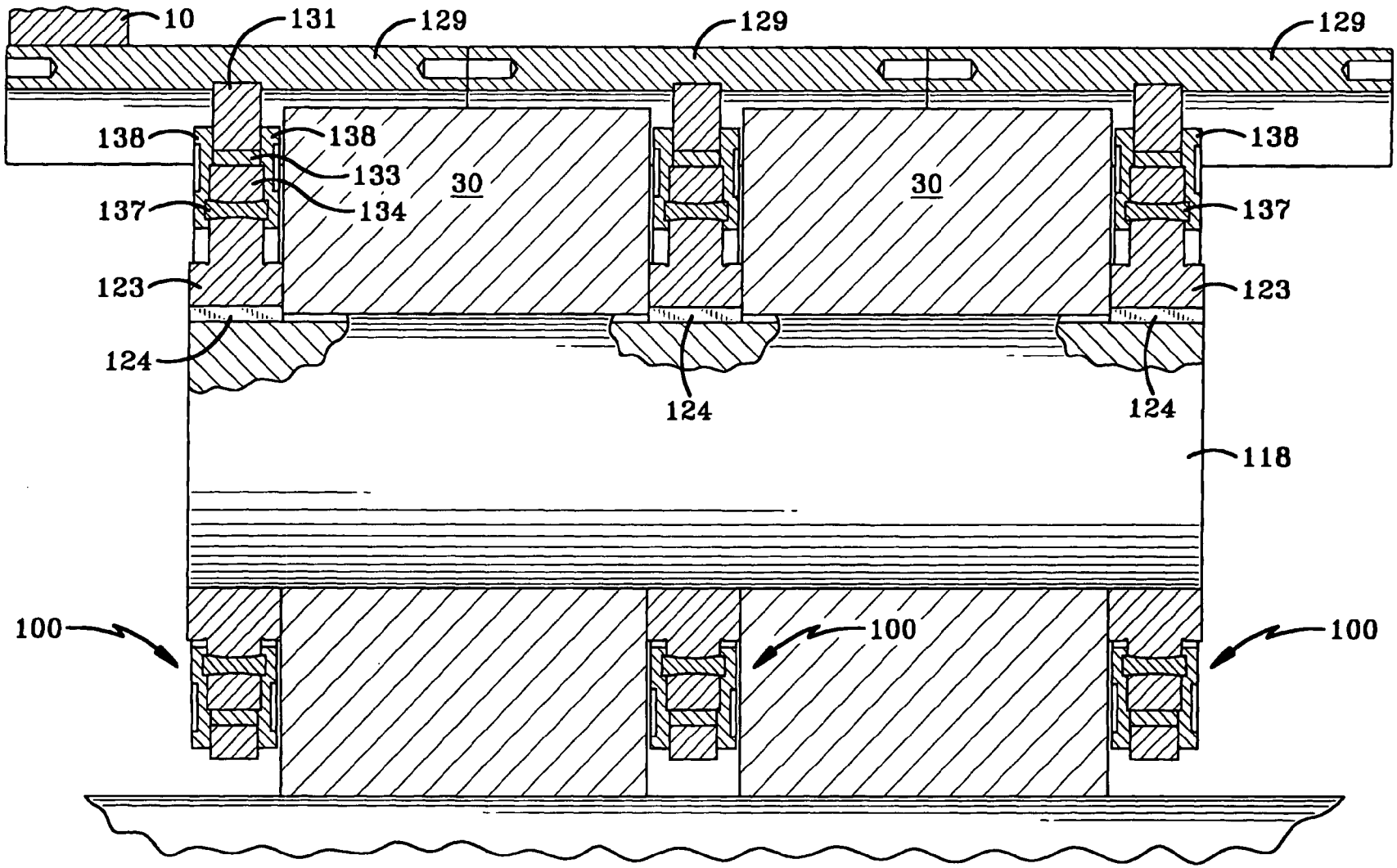
FIG. 7 is a longitudinal cross-section view of a B or C backing assembly showing three saddles supporting a portion of the shaft carrying two backing assemblies.

One exemplary saddle made in accordance with the concepts of the present invention is indicated generally by the numeral 100 in FIG. 6. Saddle 100 is used to support shaft 118 as depicted in FIG. 7. As will be described in more detail below, each saddle 100 is configured to reduce frictional wear within saddle 100 during crown adjustments.

Each saddle 100 generally includes a saddle shoe 129 that is connected to a saddle ring 131. The connection between saddle shoe 129 and saddle ring 131 may be made by an appropriate bolt or other connection arrangement as is known in the art. Each saddle 100 further includes an eccentric 123 that is connected to shaft 118. The connection between eccentric 123 and shaft 118 may be made by an appropriate connector such as the key 124 used an example in the drawings.

Figure 8C:
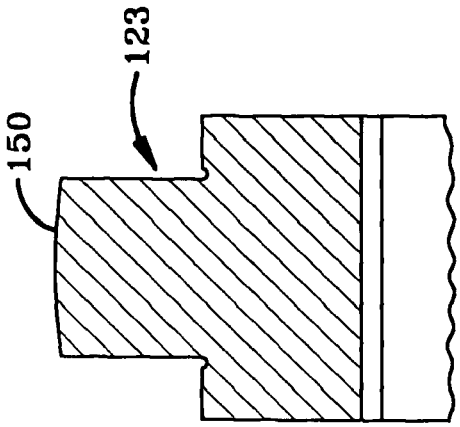
FIG. 8C is an enlarged section view of a portion of the eccentric of FIG. 8.
Figure 8D:
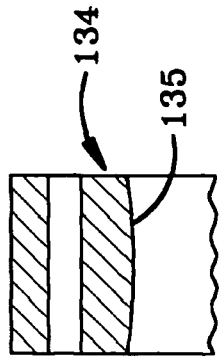
FIG. 8D is an enlarged section view of a portion of the eccentric ring of FIG. 8.
Figure 8B:
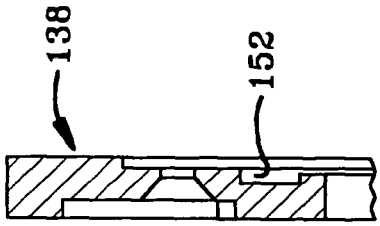
FIG. 8B is an enlarged section view of a portion of the gear ring of FIG. 8.
Figure 8A:
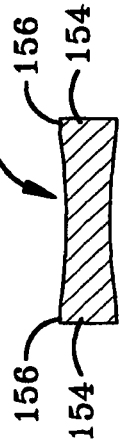
FIG. 8A is an enlarged section view of the roller of FIG. 8.
Figure 8:
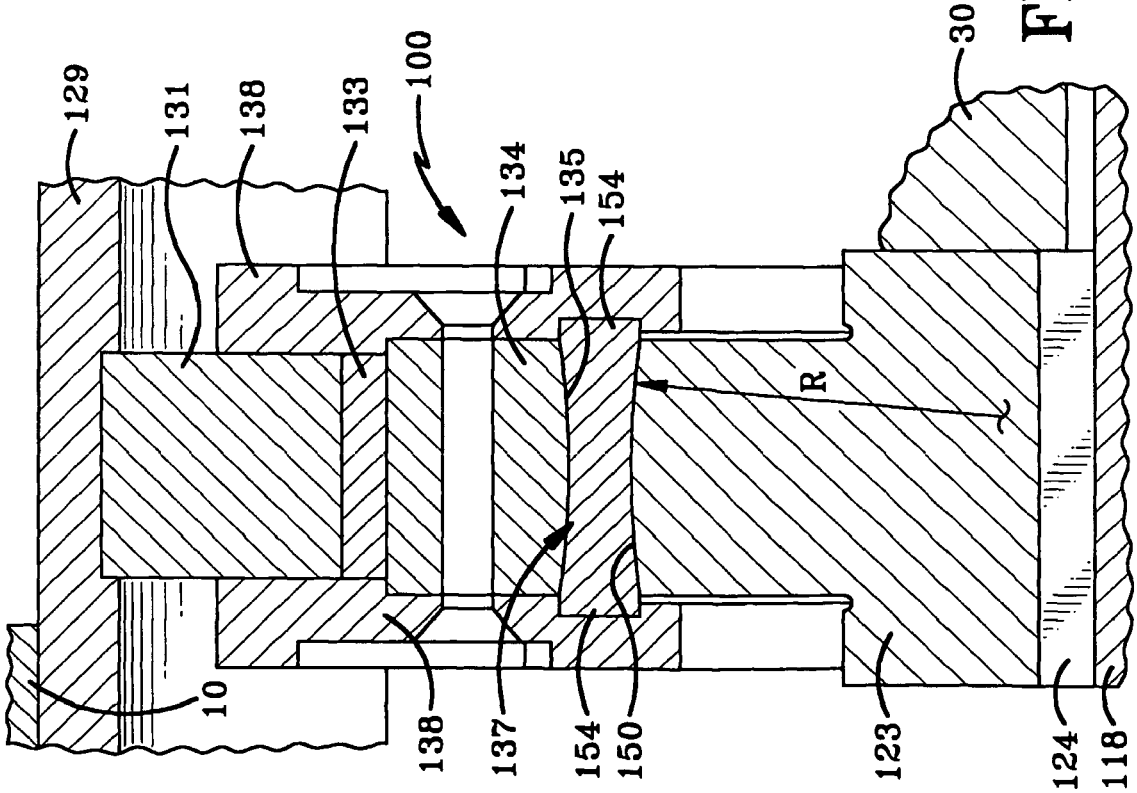
FIG. 8 is an enlarged sectional view of a portion of one of the saddles of FIG. 7.

Turning first to FIG. 8 wherein saddle 100 is a roller saddle. In the FIG. 8 embodiment, roller saddle 100 includes a plurality of rollers 133 adapted to engage the inner surface of saddle ring 131. Rollers 133 are depicted as being cylindrical rollers in FIG. 8. Rollers 133 are disposed between the inner surface of saddle ring 131 and the outer surface of a "crown adjust ring" or eccentric ring 134. Rollers 133 and the outer surface of eccentric ring 134 are substantially similar to prior art elements 33 and 34 described above.

In accordance with the objectives of one of the embodiments of the present invention, the inwardly facing bearing surface 135 of eccentric ring 134 is non-cylindrical. In the embodiment of the invention depicted in FIG. 8, bearing surface 135 is convex such that the thickness of ring 134 is greater at its middle than in its end portions. A plurality of rollers 137 are disposed between eccentric ring 134 and eccentric 123. The outer surface of each roller 137 is complementary to surface 135. As such, in the embodiment of the invention depicted in FIG. 8, the outer surface of each roller 137 is non-cylindrical and concave. The non-cylindrical shape of roller 137 also requires the outer bearing surface 150 of eccentric 123 to be complementary to the outer surface of roller 137. As such, outer bearing surface 150 of eccentric 123 is convex. The curvature of roller 137 as indicated by the R arrow in FIG. 8 may be substantially equal to the outer diameter of eccentric 123 to form a spherical bearing surface.

Gear rings 138 are used in a manner similar to gear rings 38 described above and are thus used to retain eccentric 123, eccentric ring 134, saddle ring 131, shoe 129, and rollers 133 and 137 together as one assembly. The inner portions of gear rings 138 do not directly contact eccentric 123. This spacing is used to accommodate pivotal movement of eccentric 123 with respect to saddle ring 131.

Each gear ring 138 defines a roller raceway 152 that receives an end 154 of roller 137. Gear ring 138 maintains the position of roller 137 when roller 137 is aligned with the notch 139 formed in eccentric 123. In one embodiment of the invention, each end 154 has cylindrical portions 156 that are received in raceways 152.

Figure 8E:
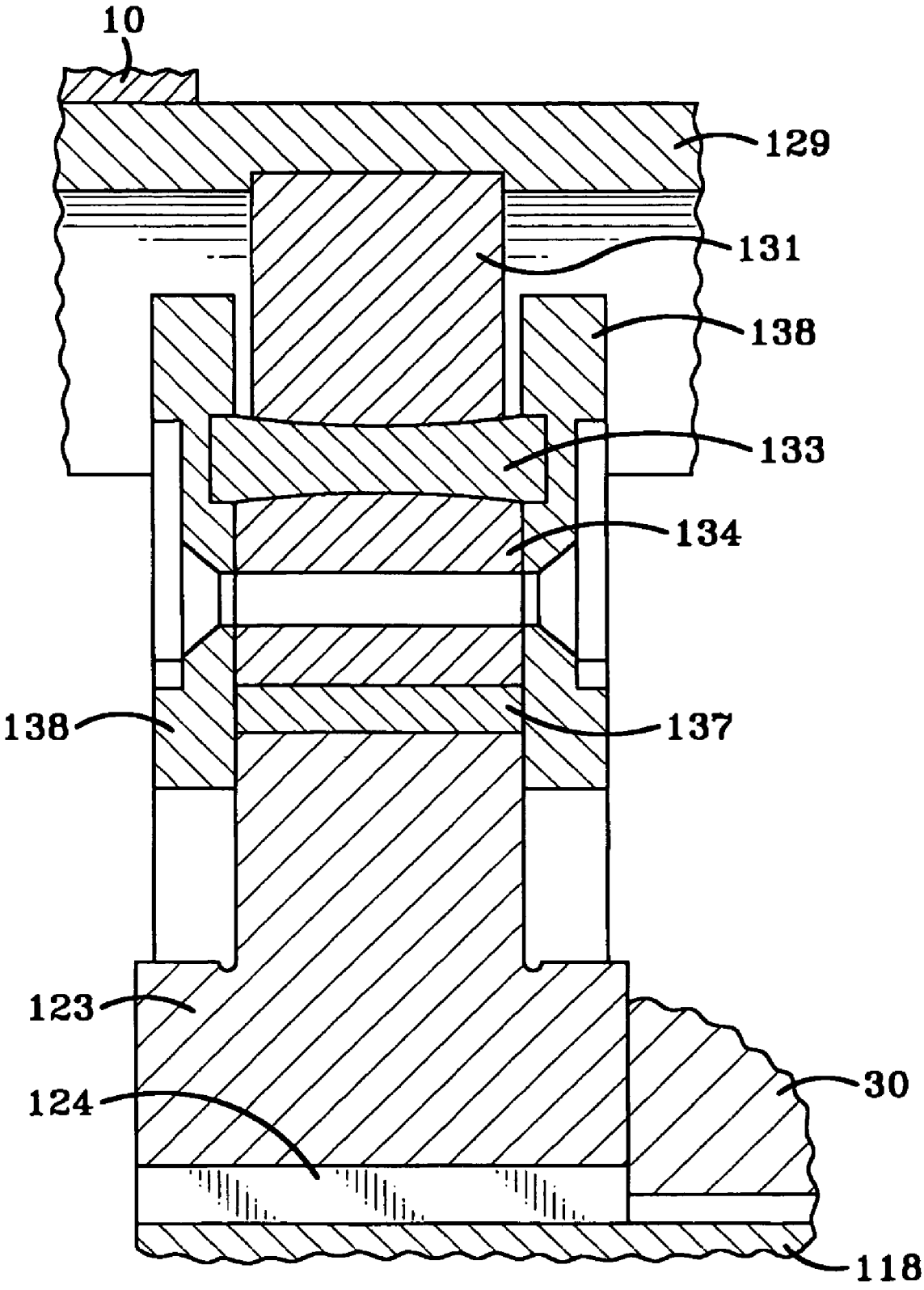
FIG. 8E is a view similar to FIG. 8 showing an alternative embodiment of the saddle.

An alternative embodiment of the invention is depicted in FIG. 8E wherein rollers 133 are provided with the non-cylindrical bearing surface.

Although roller 137 is depicted as having a concave outer surface in FIG. 8, the inventor contemplates that roller 137 may have a convex outer surface with bearing surfaces 135 and 150 being changed to be concave to complement the outer surface of roller 137. This embodiment is indicated generally by the numeral 200 in FIG. 9.

In this embodiment, each saddle 200 generally includes a saddle shoe 229 that is connected to a saddle ring 231. The connection between saddle shoe 229 and saddle ring 231 may be made by an appropriate bolt or other connection arrangement as is known in the art. Each saddle 200 further includes an eccentric 223 that is connected to shaft 218. The connection between eccentric 223 and shaft 218 may be made by an appropriate key 224.

Roller saddle 200 includes a plurality of rollers 233 adapted to engage the inner surface of saddle ring 231. Rollers 233 are depicted as being cylindrical rollers in FIG. 8. Rollers 233 are disposed between the inner surface of saddle ring 231 and the outer surface of a eccentric ring 234. Rollers 233 and the outer surface of eccentric ring 234 are substantially similar to prior art elements 33 and 34 described above.

In accordance with the objectives of one of the embodiments of the present invention, the inwardly facing bearing surface 235 of eccentric ring 234 is non-cylindrical. In the embodiment of the invention depicted in FIG. 8, bearing surface 235 is concave such that the thickness of ring 234 is greater at its ends than in its middle portions. A plurality of rollers 237 are disposed between eccentric ring 234 and eccentric 223. The outer surface of each roller 237 is complementary to surface 235. As such, in the embodiment of the invention depicted in FIG. 9, the outer surface of each roller 237 is non-cylindrical and convex. The non-cylindrical shape of roller 237 also requires the outer bearing surface 250 of eccentric 223 to be complementary to the outer surface of roller 237. As such, outer bearing surface 250 of eccentric 223 is concave. The curvature of roller 237 may be substantially equal to the outer diameter of eccentric 223.

Gear rings 238 are used in a manner similar to gear rings 38 described above and are thus used to retain eccentric 223, eccentric ring 234, saddle ring 231, shoe 229, and rollers 233 and 237 together as one assembly. The inner portions of gear rings 238 do not directly contact eccentric 223. This spacing is used to accommodate pivotal movement of eccentric 223 with respect to saddle ring 231.

Figure 9:
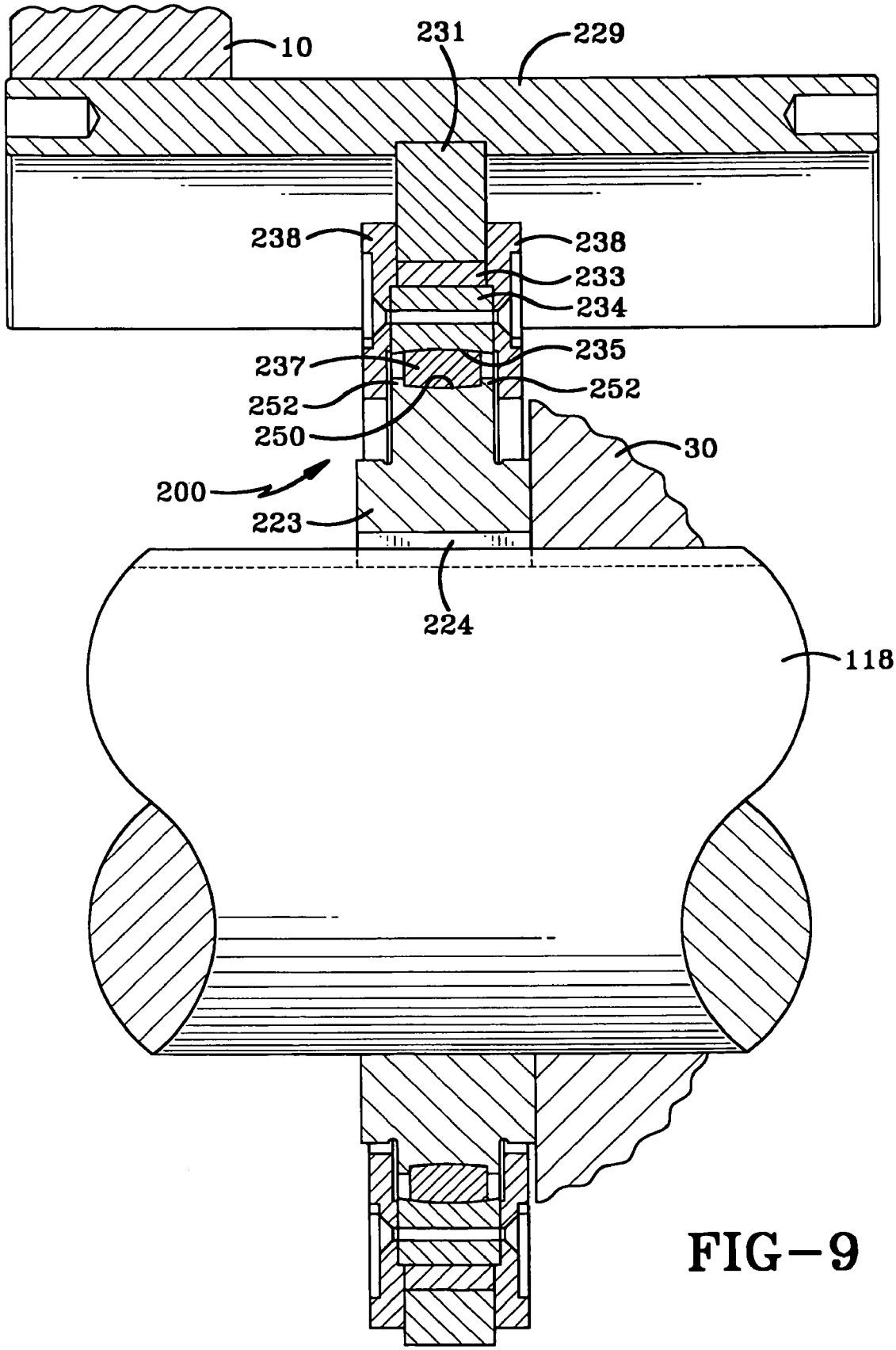
FIG. 9 is a view similar to FIG. 8 showing an alternative embodiment of the invention.
Figure 9A:
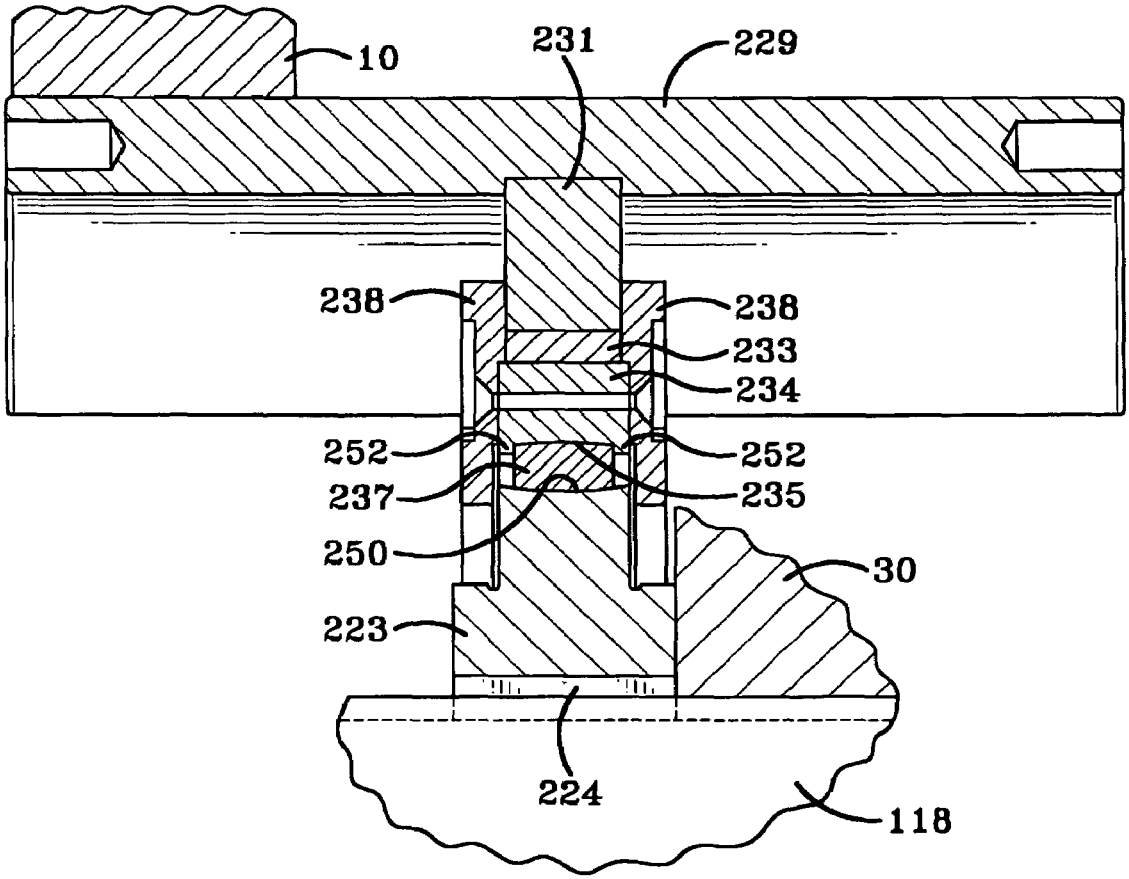
FIG. 9A is a view similar to FIG. 9 showing an alternative arrangement of the abutment walls.

As may be seen in FIG. 9, eccentric 223 provides abutment walls 252 that are disposed adjacent the end walls of rollers 237 to prevent rollers 237 from moving longitudinally with respect to eccentric 223. The use of abutment walls 252 prevents rollers 237 from being forced into gear rings 238. In an alternative embodiment of the invention, abutment walls 252 are connected to eccentric ring 234 as shown in FIG. 9A.

Figure 9B:
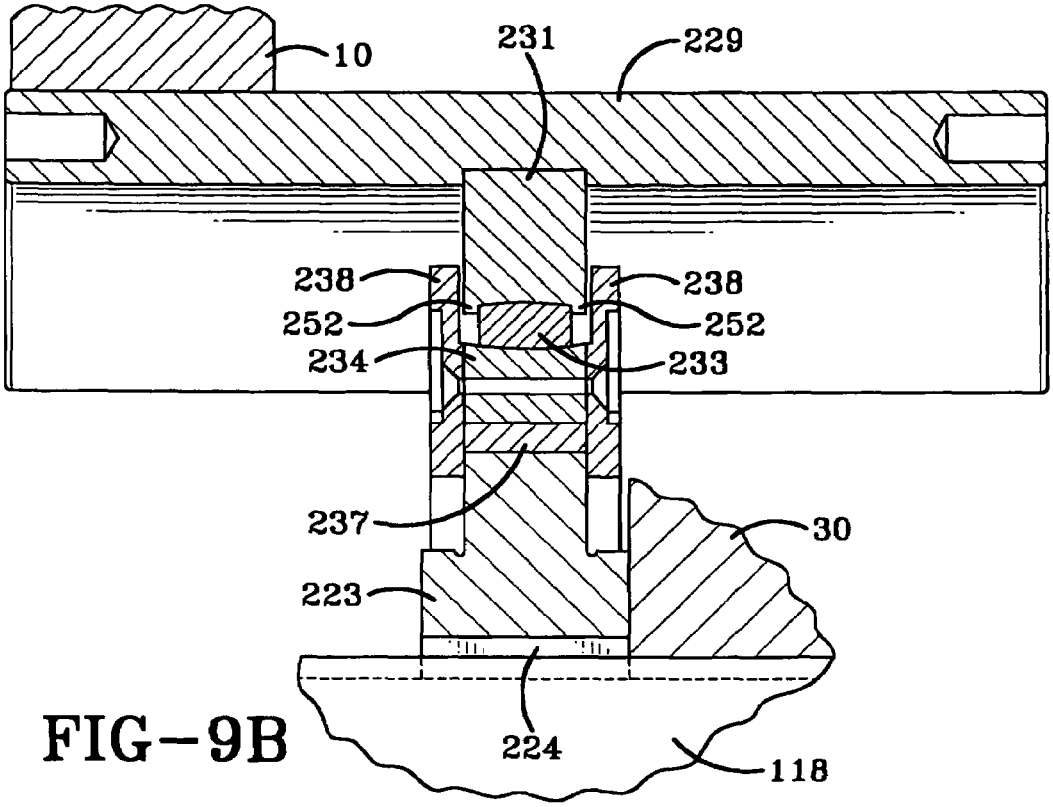
FIG. 9B is a view similar to FIG. 9 showing an alternative embodiment of the saddle.
Figure 9C:
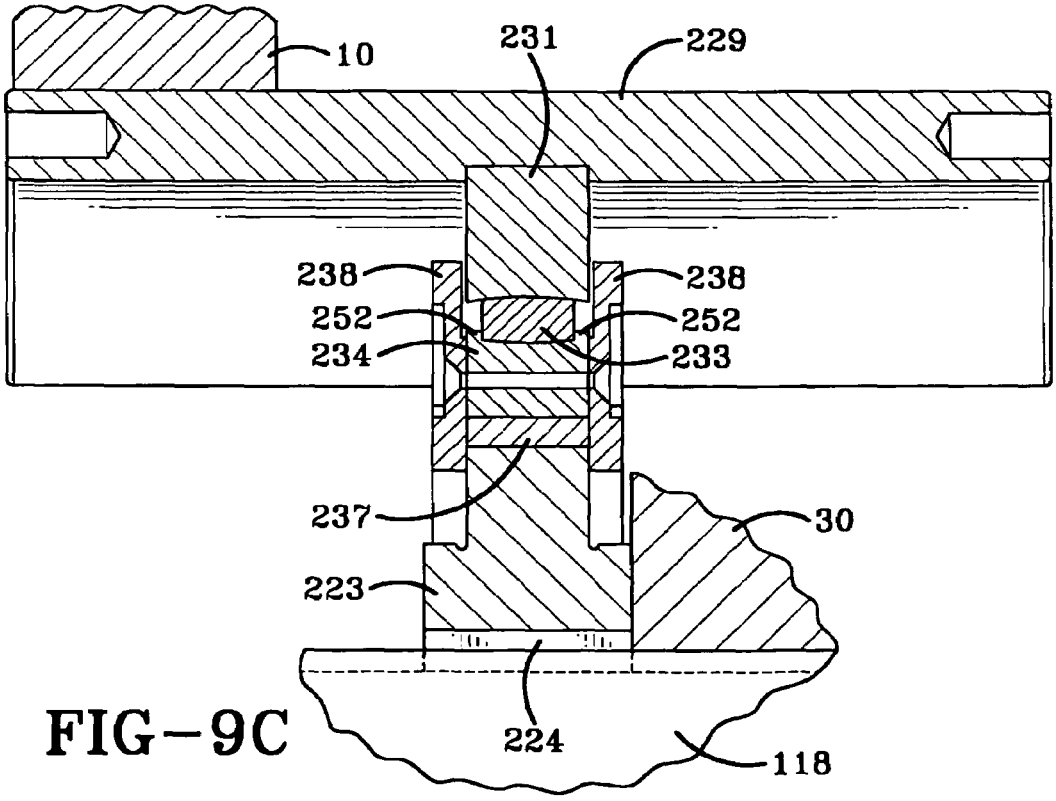
FIG. 9C is a view similar to FIG. 9B showing an alternative arrangement of the abutment walls.

An alternative embodiments of the invention are depicted in FIGS. 9B and 9C wherein rollers 233 are provided with the non-cylindrical bearing surface.

The invention allows the eccentric to pivot with respect to the saddle ring without creating excessive frictional forces in the saddle. When the operator of the cluster mill using the saddles makes a crown adjustment, the eccentric rings are rotated which causes radial movement of the eccentrics. The radial movement of the eccentric bends the shaft causing the eccentric to pivot with respect to the saddle ring. In prior art arrangements, this pivoting motion would pinch the roller and drive it into the gear ring. In the invention depicted in FIGS. 8 and 9, the pivoting movement simply causes eccentric 123,223 to pivot or slide with respect to rollers 137, 237. Rollers 137,237 are thus not pinched and is not driven into gear ring 138,238. In the invention depicted in FIGS. 8E and 9B, the pivoting movement simply causes eccentric 123,223 to pivot or slide with respect to rollers 133, 233. Rollers 133,233 are thus not pinched and is not driven into gear ring 138,238. These arrangements substantially reduce wear and allow the cluster mill using saddle 100,200 to be adjusted for more bending of the metal strip being worked by the cluster mill. The arrangement also transfers less force to saddle shoes 129,229 and prevents shoes 129,229 from warping.

Figure 10:
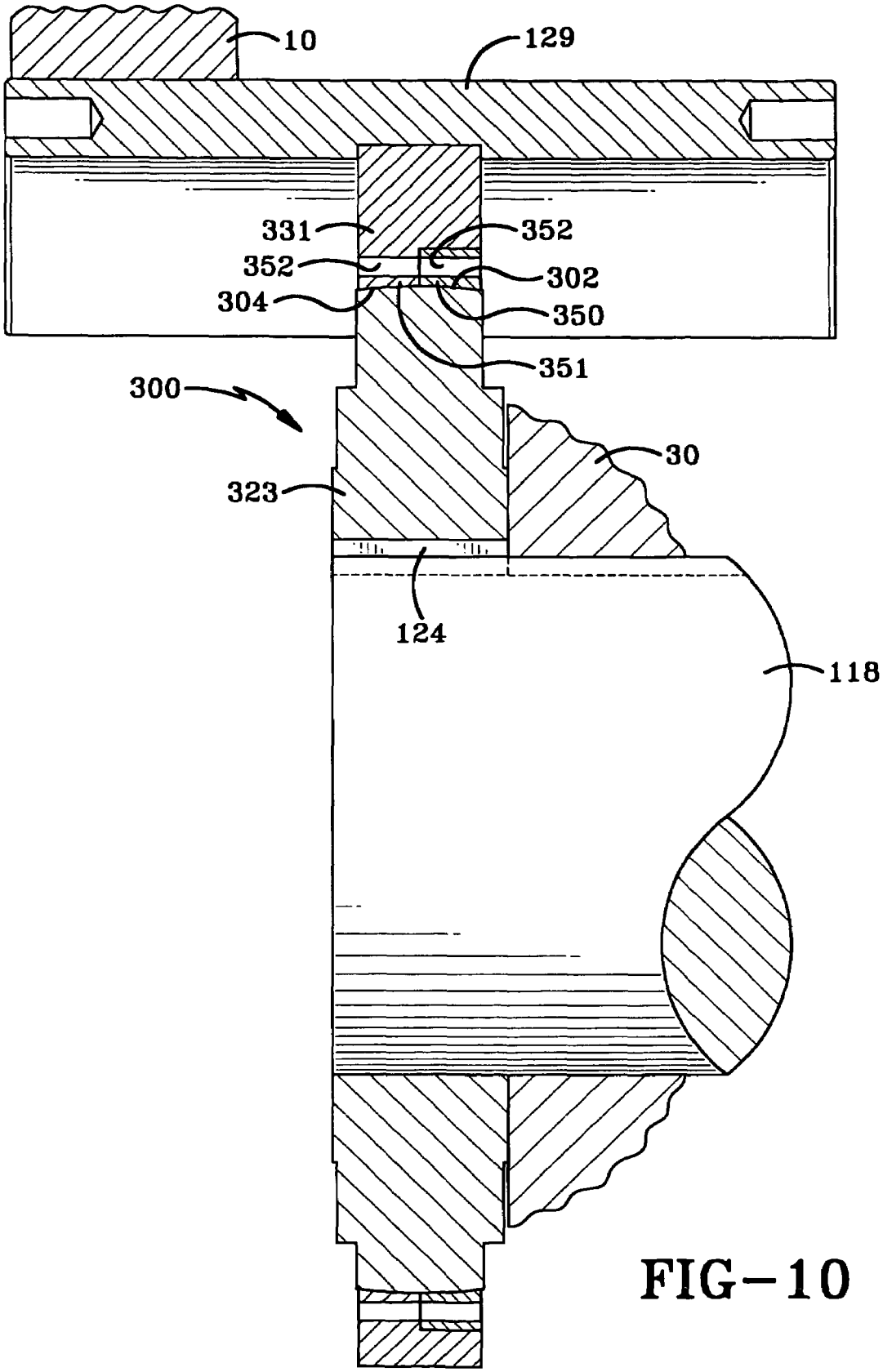
FIG. 10 is a view similar to FIG. 8 showing a saddle made in accordance with the concepts of the present invention for a plain saddle.
Figure 10A:
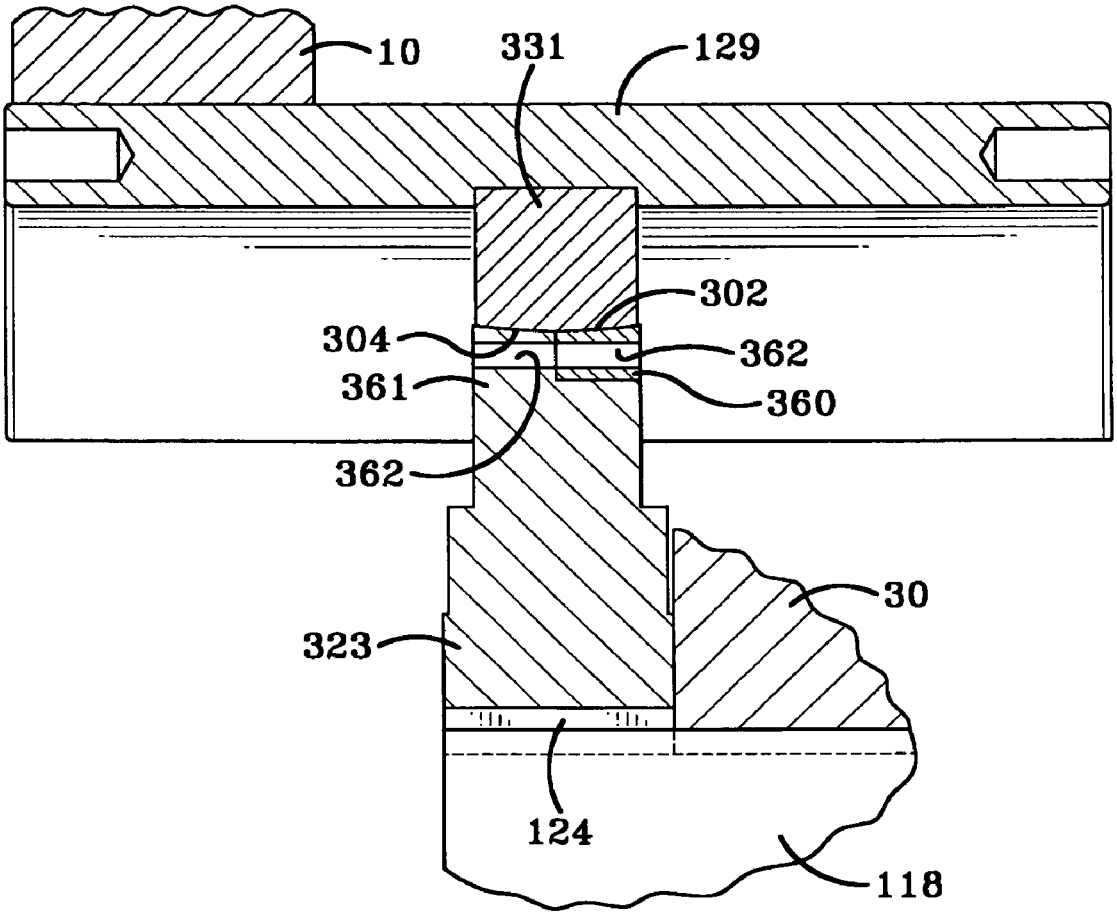
FIG. 10A is a view similar to FIG. 10 showing an alternative configuration for the plain saddle.

FIG. 10 depicts a plain saddle embodiment made in accordance with the concepts of the present invention. In the plain saddle embodiment, the saddle is indicated generally by the numeral 300. Saddle 300 includes eccentric 323 having an outer bearing surface 302 that is non-cylindrical and may be a spherical bearing surface. Outer bearing surface 302 of eccentric 323 engages the inner bearing surface 304 of saddle ring 331. Bearing surface 304 complements bearing surface 302. In the embodiment depicted in FIG. 10, bearing surface 302 is convex with bearing surface 304 being concave. In another embodiment of the invention shown in FIG. 10A, bearing surface 304 may be convex (with respect to ring 331) with bearing surface 302 being concave (with respect to eccentric 323). The curvature of bearing surfaces 302 and 304 reduce wear between eccentric 323 and saddle ring 331 in a manner similar to that described above.

As also shown in FIG. 10, saddle ring 331 is formed from two pieces that are connected together around eccentric 323. In the exemplary embodiment, saddle ring 331 is split at its centerline into a first ring 350 and a second ring 351. Each ring 350 and 351 defines a connector opening 352 that cooperate and are coaxial when rings 350 and 351 are assembled. Openings 352 are configured to receive a connector that holds rings 350 and 351 together. The connector may be any of a variety of connectors known in the art such as bolts, screws, pins, keys, and the like. The split of ring 331 may extend across the entire radial thickness of ring 331 or only a portion of the radial thickness as shown in the drawing. The split allows eccentric 323 to be sandwiched between rings 350 and 351 during assembly of saddle 300. In the alternative embodiment shown in FIG. 10A, eccentric 323 is formed from two rings 360 and 361 with connector openings 362.

Figure 11:
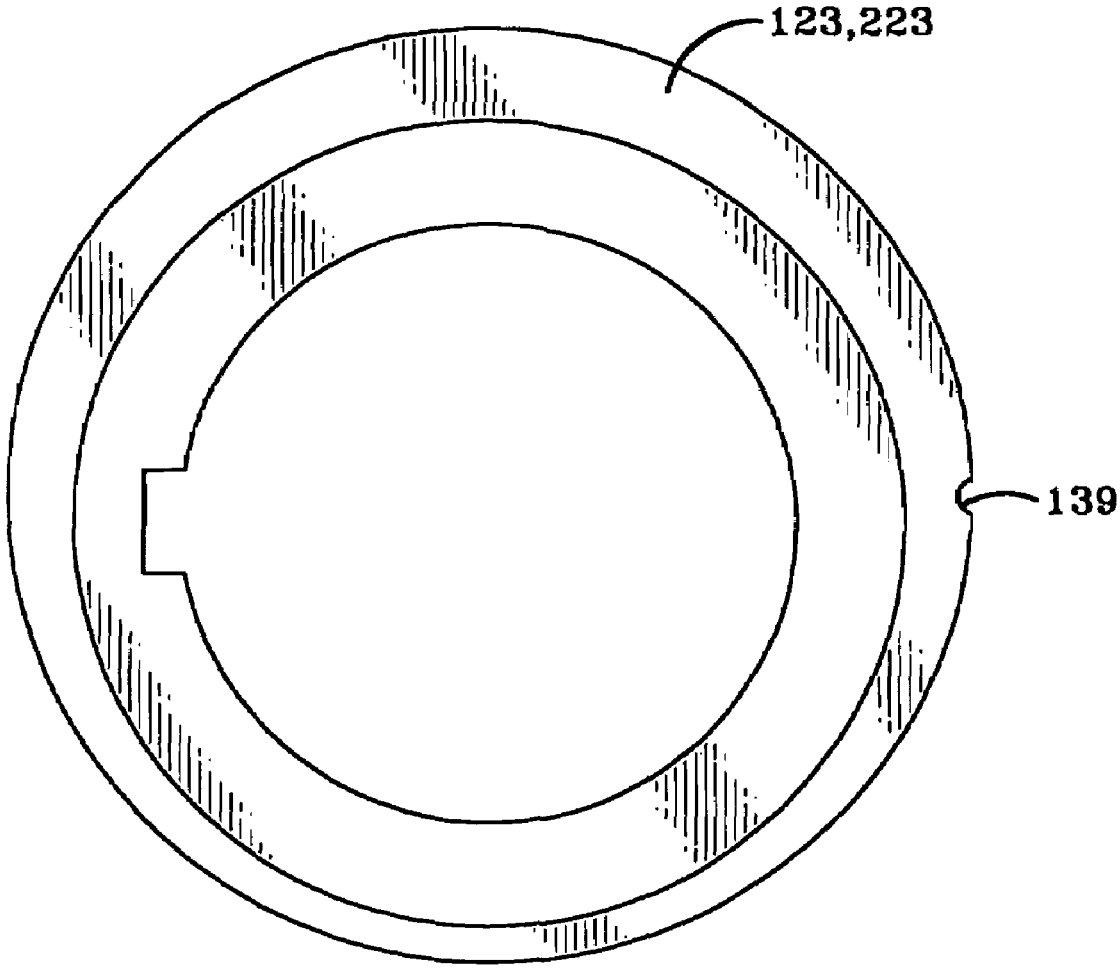
FIG. 11 is an elevation view of the showing the notch that allows the rollers to be loaded into the assembly.

In the roller embodiments, the rollers having the curved bearing surfaces may be installed through a notch such as notch 139 (FIG. 11) defined by eccentric 123 or 223. Notch 139 is positioned away from the majority of the load-bearing rollers so that the rollers positioned at notch 139 are not subjected to a full load during crown adjustment or mill operation. Notch 139 is sized to allow each roller to slip into place and then be rotated into position. In other embodiments of the invention, the notch is provided in other elements of the mill as required by the position of the non-cylindrical roller. The loading of the rollers through this notch (shown in FIG. 11) provides a new method of assembling a saddle.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A saddle for a backing assembly in a rolling mill; the saddle adjustably supporting a shaft; the saddle comprising:

a saddle ring of a saddle for a backing assembly in a rolling mill; the saddle ring having an inner bearing surface; the inner bearing surface having an axial length;

an eccentric of a saddle for a backing assembly in a rolling mill; the eccentric adapted to be connected to the shaft;

the eccentric having an outer bearing surface that engages the inner bearing surface of the saddle ring; the outer bearing surface having an axial length; and the inner and outer bearing surfaces being complementary; one of the inner and outer bearing surfaces being concave along a portion of its axial length and the other of the inner and outer bearing surfaces being convex along a portion of its axial length.

2. The saddle of claim 1, wherein the outer bearing surface of the eccentric is convex with respect to the eccentric and wherein the inner bearing surface of the saddle ring is concave with respect to the saddle ring.

3. The saddle of claim 2, wherein the outer bearing surface of the eccentric is a spherical bearing surface.

4. The saddle of claim 2, wherein the saddle ring includes first and second rings with each of the first and second rings defining a portion of the inner bearing surface.

5. The saddle of claim 4, wherein the saddle ring has a radial thickness; the second ring of the saddle ring having a radial thickness that is less than radial thickness of the saddle ring.

6. The saddle of claim 4, wherein the first and second rings of the saddle ring define connector openings that are coaxial when the first and second rings are assembled to form the saddle ring.

7. The saddle of claim 1, wherein the outer bearing surface of the eccentric is concave with respect to the eccentric and wherein the inner bearing surface of the saddle ring is convex with respect to the saddle ring.

8. The saddle of claim 7, wherein the eccentric includes first and second rings with each of the first and second rings defining a portion of the outer bearing surface.

9. The saddle of claim 8, wherein the eccentric has a radial thickness;

the second ring of the eccentric having a radial thickness that is less than radial thickness of the eccentric.

10. The saddle of claim 8, wherein the first and second rings of the eccentric define connector openings that are coaxial when the first and second rings are assembled to form the saddle ring.

11. The saddle of claim 1, further comprising a saddle shoe connected to the saddle ring.

12. A saddle for a backing assembly in a rolling mill; the saddle adjustably supporting a shaft; the saddle comprising:

a saddle ring having a inner bearing surface;

an eccentric ring having an outer bearing surface and an inner bearing surface; the eccentric ring being disposed radially inward of the saddle ring;

an eccentric adapted to be connected to the shaft;

a plurality of first rollers disposed intermediate the eccentric and the eccentric ring; each of the first rollers having a first bearing surface; each of the first bearing surfaces having an axial length;

the eccentric having an outer bearing surface that engages the first bearing surfaces of the first rollers; the outer bearing surface having an axial length; and the outer bearing surface of the eccentric and the first bearing surface being complementary; one of the outer and first bearing surfaces being concave along a portion of its axial length and the other of the outer and first bearing surfaces being convex along a portion of its axial length.

13. The saddle of claim 12, wherein the outer bearing surface of the eccentric is convex with respect to the eccentric and wherein the bearing surface of each first roller is concave.

14. The saddle of claim 13, wherein the outer bearing surface of the eccentric is a spherical bearing surface.

15. The saddle of claim 13, wherein the inner bearing surface of the eccentric ring is convex with respect to the eccentric ring; the convex inner bearing surface of the eccentric ring being complementary to the concave bearing surface of each first roller.

16. The saddle of claim 13, further comprising a pair of gear rings connected to the eccentric ring; each of the gear rings defining a roller raceway aligned with each of the first rollers.

17. The saddle of claim 16, wherein a portion of each of the first rollers is disposed in each of the roller raceways.

18. The saddle of claim 17, wherein each of the first rollers has cylindrical end portions that are at least partially disposed in the roller raceways.

19. The saddle of claim 12, wherein the outer bearing surface of the eccentric is concave with respect to the eccentric and wherein the bearing surface of each first roller is convex.

20. The saddle of claim 19, wherein the inner bearing surface of the eccentric ring is concave with respect to the eccentric ring; the concave inner bearing surface of the eccentric ring being complementary to the convex bearing surface of each first roller.

21. The saddle of claim 19, wherein one of the eccentric and eccentric ring includes a pair of opposed abutment walls; each of the first rollers being partially disposed between the opposed abutment walls.

22. The saddle of claim 12, further comprising a saddle shoe connected to the saddle ring.

23. The saddle of claim 12, further comprising a plurality of second rollers disposed between the saddle ring and the eccentric ring.

24. The saddle of claim 12, further comprising a pair of gear rings connected to the eccentric ring; each of the gear rings being spaced from the eccentric.

25. The saddle of claim 24, wherein each of the gear rings defines a roller raceway aligned with the plurality of first rollers.

26. The saddle of claim 25, wherein a portion of each of the first rollers is disposed in each of the roller raceways.

27. A saddle for a backing assembly in a rolling mill; the saddle adjustably supporting a shaft; the saddle comprising:

a saddle ring having an inner bearing surface;

an eccentric ring having an outer bearing surface and an inner bearing surface;

an eccentric adapted to be connected to the shaft; the eccentric disposed radially inwardly of the eccentric ring;

a plurality of first rollers disposed intermediate the saddle ring and the eccentric ring; each of the first rollers having first bearing surface; each first bearing surface having an axial length;

the inner bearing surface of the saddle ring engaging the first bearing surfaces of the first rollers; the inner bearing surface of the saddle ring having an axial length; and the saddle ring inner bearing surface and first bearing surfaces being complementary; one of the saddle ring inner and first bearing surfaces being concave along a portion of its length and the other of the saddle ring inner and first bearing surfaces being convex along a portion of its length.

28. The saddle of claim 27, wherein the inner bearing surface of the saddle ring is convex with respect to the saddle ring and wherein the bearing surface of each first roller is concave.

29. The saddle of claim 28, wherein the outer bearing surface of the eccentric ring is convex with respect to the eccentric ring; the convex outer bearing surface of the eccentric ring being complementary to the concave bearing surface of each first roller.

30. The saddle of claim 29, wherein the outer bearing surface of the eccentric ring is a spherical bearing surface.

31. The saddle of claim 28, further comprising a pair of gear rings connected to the eccentric ring; each of the gear rings defining a roller raceway aligned with each of the first rollers.

32. The saddle of claim 31, wherein a portion of each of the first rollers is disposed in each of the roller raceways.

33. The saddle of claim 32, wherein each of the first rollers has cylindrical end portions that are at least partially disposed in the roller raceways.

34. The saddle of claim 27, wherein the inner bearing surface of the saddle ring is concave with respect to the saddle ring and wherein the bearing surface of each first roller is convex.

35. The saddle of claim 34, wherein the outer bearing surface of the eccentric ring is concave with respect to the eccentric ring; the concave outer bearing surface of the eccentric ring being complementary to the convex bearing surface of each first roller.

36. The saddle of claim 34, wherein one of the saddle ring and eccentric ring includes a pair of opposed abutment walls; each of the first rollers being partially disposed between the opposed abutment walls.

37. The saddle of claim 27, further comprising a saddle shoe connected to the saddle ring.

38. The saddle of claim 27, further comprising a plurality of second rollers disposed between the saddle ring and the eccentric ring.

39. The saddle of claim 27, further comprising a pair of gear rings connected to the eccentric ring; each of the gear rings being spaced from the saddle ring.

40. The saddle of claim 39, wherein each of the gear rings defines a roller raceway aligned with the plurality of first rollers.

41. The saddle of claim 40, wherein a portion of each of the first rollers is disposed in each of the roller raceways.

* * * * *